United States Patent [19]

Hayashi et al.

[11] Patent Number: 4,664,593

[45] Date of Patent: May 12, 1987

[54] BLADE CONFIGURATION FOR SHROUDED MOTOR-DRIVEN FAN

[75] Inventors: Masaharu Hayashi, Toyota; Makoto Nakagawa, Kariya, both of Japan

[73] Assignee: Aisin Seiki Kabushiki Kaisha, Japan

[21] Appl. No.: 597,607

[22] Filed: Apr. 6, 1984

[30] Foreign Application Priority Data

Apr. 8, 1983 [JP] Japan ..... 58-60937

[51] Int. Cl.[4] ..... F04D 29/38

[52] U.S. Cl. ..... 415/119; 416/184; 416/223 R

[58] Field of Search ..... 416/223 R, 234, 183–185; 415/119, DIG. 1

[56] References Cited

U.S. PATENT DOCUMENTS

| | | | |
|---|---|---|---|
| 145,227 | 4/1846 | Pryne | 416/223 R |
| 1,932,881 | 10/1933 | Bowen et al. | 415/142 |
| 2,415,380 | 2/1947 | Weber | 416/234 |
| 2,917,227 | 12/1959 | Ruegsegger | 415/148 |
| 2,978,040 | 4/1961 | Wirkkala | 416/234 |
| 3,531,221 | 9/1970 | Herberg et al. | 416/223 R |
| 3,594,098 | 7/1971 | Pratinidhi | 416/144 |
| 3,758,231 | 9/1973 | Barnstead | 416/230 |
| 3,842,902 | 10/1974 | Poslusny | 165/51 |
| 4,175,640 | 11/1979 | Birch et al. | 416/234 |
| 4,359,311 | 11/1982 | Benesh | 416/DIG. 2 |

FOREIGN PATENT DOCUMENTS

| | | | |
|---|---|---|---|
| 388521 | 2/1965 | Switzerland | 415/416 |
| 946794 | 1/1964 | United Kingdom | 416/234 |
| 244895 | 1/1981 | U.S.S.R. | 416/223 R |

*Primary Examiner*—Robert E. Garrett
*Assistant Examiner*—John Kwon
*Attorney, Agent, or Firm*—Finnegan, Henderson, Farabow, Garrett & Dunner

[57] ABSTRACT

A motor-driven fan including a hub adapted to be driven by a motor, a plurality of fan blades provided on the hub to extend in radial directions, a shroud including a ring-shaped portion encircling the fan blades and stay members for supporting the ring-shaped portion, each of the fan blades being formed at a tip end thereof with a deflector which is bent in a direction of rotation of the fan by a width which increases from a leading edge to a trailing edge of the blade.

4 Claims, 4 Drawing Figures

BLADE CONFIGURATION FOR SHROUDED MOTOR-DRIVEN FAN

The present invention relates to a fan structure and more particularly to a fan blade configuration.

Hithertofore, in the field of a shrouded fan which includes a motor-driven hub carrying a plurality of radially extending fan blades and a shroud having a ring-shaped portion encircling the fan blades and stay members for supporting the ring-shaped portion, there has been a problem of noise being produced by a stream of air impinging upon the interconnections between the ring-shaped portion and the stay members. Since the noise is caused by such air stream having a radially outward speed component, efforts have been made to suppress radially outward speed component. For example, Japanese utility model disclosure No. 55-35363 teaches to provide fan blades with beads at the tip portions thereof. Japanese utility model disclosure No. 55-90796 teaches to form flanges at the tip ends of the fan blades. Although efforts have thus been made in the past, they have not been successful to suppress the noise to a satisfactory extent.

It is therefore an object of the present invention to provide a fan blade configuration which can eliminate the aforementioned problems in the conventional fan blades.

Another object of the present invention is to provide a fan blade configuration which does not produce air stream noise when it is applied to a shrouded fan.

According to the present invention, the above and other objects can be accomplished by a fan blade having a radially inner and tipends, and a leading and trailing edges, said fan blade being formed at the tip end with a deflector bent in forward direction by a width which increases from the leading edge to the trailing edge. According to a further aspect of the present invention, there is provided a motor-driven fan including a hub adapted to be driven by a motor, a plurality of fan blades provided on said hub to extend in radial directions, a shroud including a ring-shaped portion encircling the fan blades and stay members for supporting said ring-shaped portion, each of said fan blades being formed at a tip end thereof with a deflector which is bent in a direction of rotation of the fan by a width which increases from a leading edge to a trailing edge of the blade. Preferably, each fan blade is formed with a guide section which extends from said deflector in the direction of rotation of the fan and has a substantially straight cross-section.

The above and other objects and features of the present invention will become apparent from the following description of a preferred embodiment taking reference to the accompanying drawings, in which.

Figure 1:
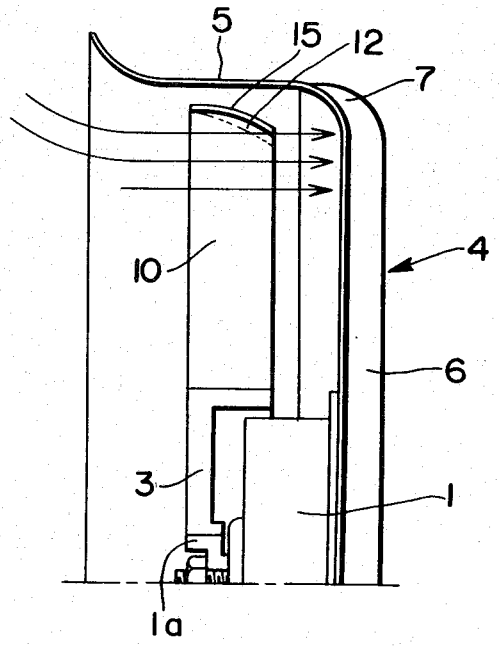
FIG. 1 is a sectional view of a motor-driven fan in accordance with one embodiment of the present invention.
Figure 2:
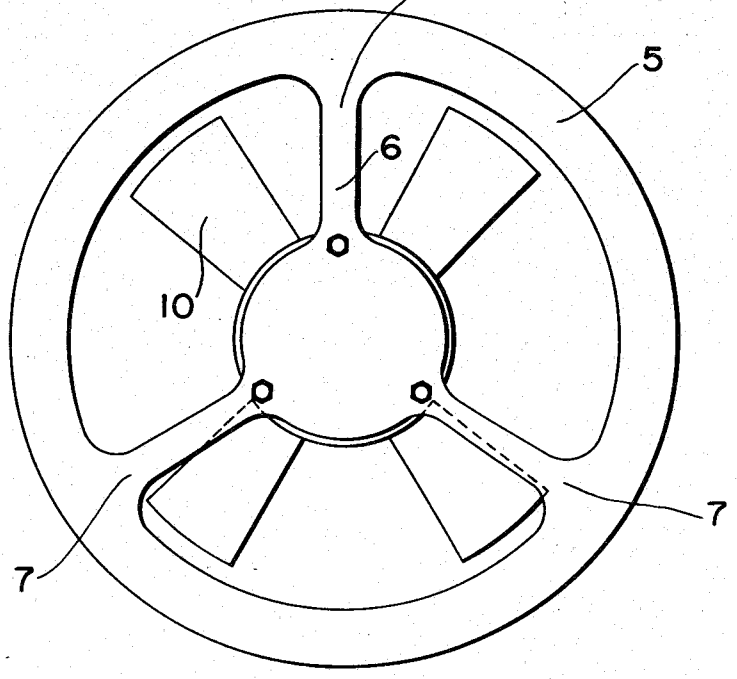
FIG. 2 is a front view of the fan shown in FIG. 1.

Referring now to the drawings, particularly to FIGS. 1 and 2, there is shown a motor-driven fan which includes a motor 1 having an output shaft 1*a*. A fan boss 3 is secured to the output shaft 1*a* of the motor 1 and carries a plurality of fan blades 10 which extend in radial directions. The fan further includes a shroud 4 which is comprised of a ring-shaped portion 5 encircling the fan blades 10 and a plurality of spiders or stay members 6 which are secured on one hand to the casing of the motor 1 and on the other hand connected to the ring-shaped portion 5 at junctions 7.

Figure 3:
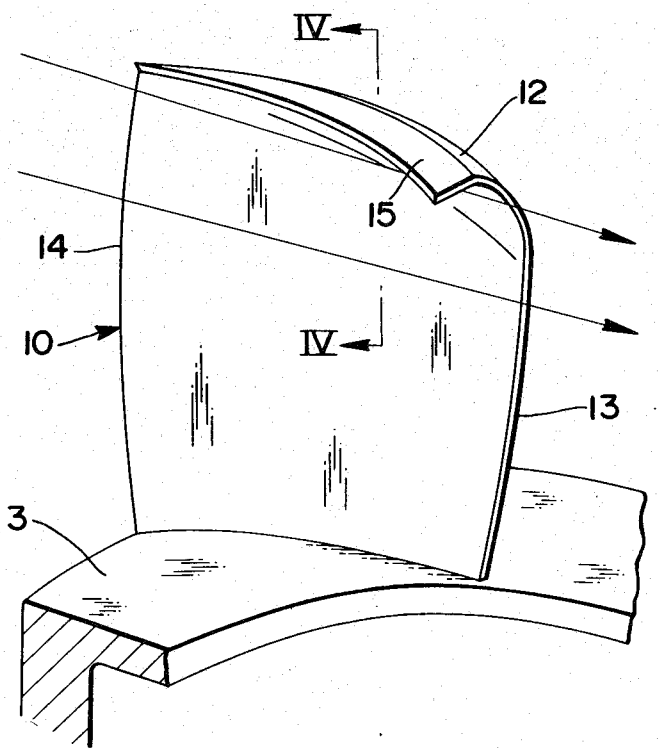
FIG. 3 is a fragmentary perspective view showing the fan blade configuration in the embodiment shown in FIG. 1.
Figure 4:
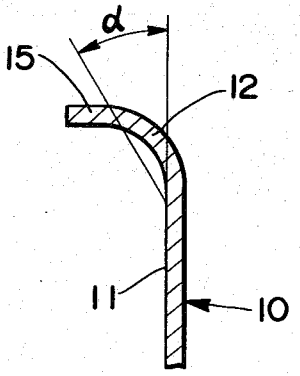
FIG. 4 is a sectional view taken substantially along the line IV—IV in FIG. 3.

Referring now to FIGS. 3 and 4, it will be noted that the fan blade 10 is secured to or integrally formed with the hub 3 and has a trailing edge 13 and a leading edge 14. At the tip end, the fan blade 10 is formed with a deflector 12 which is an arcuately curved portion bent from the body of the fan blade in the forward direction or the direction of rotation of the fan. The deflector 12 has a width which increases gradually from the leading edge 14 to the trailing edge 13. A guide section 15 having a substantially straight cross-sectional configuration is formed to extend forwardly or in the direction of rotation of the fan from the deflector 12. The guide section 15 also has a width which increases from the leading edge 14 to the trailing edge 13.

The configuration of the deflector 12 may be represented in terms of an angle $\alpha$ which is as shown in FIG. 4 an angle between the surface of the body of the fan blade 10 and a line passing through the starting point and the ending point of the deflector 12. The angle $\alpha$ may be 10° to 60°, preferably 30°. In the embodiment illustrated in the drawings, the radial dimension of the fan blade 10 is slightly decreased from the leading edge 14 to the trailing edge 13. The configurations of the fan blades 10 are found effective to deflect the air stream away from the junctions 7 in the shroud 4 so that it is possible to suppress or eliminate the noise which may otherwise be produced by the air stream impinging upon the shroud 4 at the junctions 7.

The invention has thus been shown and described with reference to a specific embodiment, however, it should be noted that the invention is in no way limited to the details of the illustrated structures but changes and modifications may be made without departing from the scope of the appended claims.

We claim:

1. A fan blade having radially inner and tip ends, and leading and trailing edges, said tip end being provided with a curved deflector bent in the direction of rotation of the fan and a guide section extending from said deflector in the same direction as said deflector and having a substantially straight cross-section, said deflector and said guide section having widths which increase from the leading edge to the trailing edge.

2. A fan blade in accordance with claim 1 which has a length larger at the leading edge than at the trailing edge.

3. A motor-driven fan including a hub adapted to be driven by a motor, a plurality of fan blades provided on said hub to extend in radial directions, a shroud including a ring-shaped portion encircling the fan blades and stay members for supporting said ring-shaped portion, each of said fan blades being formed at a tip end thereof with a curved deflector which is bent in a direction of rotation of the fan said fan blade having a guide section extending from said deflector in the same direction as said deflector and said guide section having a substantially straight cross-section and said deflector and guide section having widths which increase from a leading edge to a trailing edge of the blade.

4. A fan blade according to claim 1 wherein an angle between the surface of said blade's body and the chord of the deflector is 10° to 60°.

* * * * *